US012352265B2

(12) United States Patent
Hopkins et al.

(10) Patent No.: US 12,352,265 B2
(45) Date of Patent: Jul. 8, 2025

(54) COMPRESSOR HAVING COMPRESSION SUBASSEMBLY AND METHODS OF ASSEMBLING THE SAME

(71) Applicant: Copeland LP, Sidney, OH (US)

(72) Inventors: Stephen Hopkins, Dayton, OH (US); Kyle M. Bergman, Yorkshire, OH (US); David Loerke, Troy, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 18/485,911

(22) Filed: Oct. 12, 2023

(65) Prior Publication Data

US 2025/0122873 A1 Apr. 17, 2025

(51) Int. Cl.
*F04C 18/02* (2006.01)

(52) U.S. Cl.
CPC ..... *F04C 18/0215* (2013.01); *F04C 2230/60* (2013.01); *F04C 2240/30* (2013.01); *F04C 2240/50* (2013.01); *F04C 2240/60* (2013.01); *F04C 2240/805* (2013.01)

(58) Field of Classification Search
CPC ..... F04C 18/0215; F04C 2230/60; F04C 2240/30; F04C 2240/50; F04C 2240/60; F04C 2240/805
See application file for complete search history.

(56) References Cited

U.S. PATENT DOCUMENTS 4,767,293 A * 8/1988 Caillat ..... F04C 27/005 418/57
4,838,773 A 6/1989 Noboru
4,929,160 A 5/1990 Inoue
5,055,012 A 10/1991 Sakashita et al.
5,192,202 A * 3/1993 Lee ..... F04C 27/005 418/57

(Continued)

FOREIGN PATENT DOCUMENTS

CN 2007085205 A * 3/2018
CN 110173428 A * 8/2019 ..... F04C 18/0215

(Continued)

OTHER PUBLICATIONS

English Machine Translation of CN105971844B translated via US Fit database (Year: 2018).*

(Continued)

*Primary Examiner* — Dominick L Plakkoottam
*Assistant Examiner* — Paul W Thiede
(74) *Attorney, Agent, or Firm* — Armstrong Teasdale LLP

(57) ABSTRACT

A compressor includes a compressor housing and a compression subassembly installed in the compressor housing. The compressor housing includes a shell defining a first chamber and an end cap defining a second chamber. The compression subassembly includes a support plate positioned in the compressor housing between the shell and the end cap, a non-orbiting scroll attached to the support plate and extending from the support plate into the first chamber, a main bearing housing positioned in the first chamber and attached to the non-orbiting scroll, and an orbiting scroll positioned between the non-orbiting scroll and the main (Continued)

bearing housing. The support plate separates the first chamber and the second chamber and supports the compression subassembly in the compressor housing.

20 Claims, 10 Drawing Sheets

(56) References Cited

U.S. PATENT DOCUMENTS

| | | | | |
|---|---|---|---|---|
| 5,540,572 | A * | 7/1996 | Park | F04C 18/0253 418/55.6 |
| 6,027,321 | A * | 2/2000 | Shim | F04C 23/008 418/270 |
| 6,280,155 | B1 | 8/2001 | Dreiman | |
| 6,422,842 | B2 | 7/2002 | Sheridan et al. | |
| 7,527,484 | B2 | 5/2009 | Kim et al. | |
| 7,905,715 | B2 | 3/2011 | Hiwata et al. | |
| 8,328,543 | B2 * | 12/2012 | Wilson | F04C 29/126 137/533.19 |
| 10,294,938 | B2 * | 5/2019 | Imai | F04C 27/005 |
| 10,890,184 | B2 | 1/2021 | Iwatake et al. | |
| 10,890,187 | B2 | 1/2021 | Fukuhara et al. | |
| 10,920,774 | B2 | 2/2021 | Matsui et al. | |
| 10,941,773 | B2 * | 3/2021 | Yamada | F04C 28/06 |
| 10,975,865 | B2 * | 4/2021 | Crum | F04C 18/0215 |
| 11,028,848 | B2 | 6/2021 | Okamoto et al. | |
| 11,231,035 | B2 | 1/2022 | Iwatake et al. | |
| 2008/0101972 | A1 * | 5/2008 | Tarng | F04C 29/126 418/55.6 |
| 2017/0002811 | A1 * | 1/2017 | Duppert | F04C 18/0246 |
| 2017/0167485 | A1 * | 6/2017 | Lee | F04C 23/008 |

FOREIGN PATENT DOCUMENTS

| | | | | |
|---|---|---|---|---|
| EP | 1876358 | B1 | 2/2010 | |
| JP | 105971884 | B * | 4/2007 | |
| JP | 2007100543 | A * | 4/2007 | F04C 18/0215 |
| WO | 2020188738 | A1 | 9/2020 | |
| WO | 2020208803 | A1 | 10/2020 | |

OTHER PUBLICATIONS

English Machine Translation of JP2007085205A translated via US Fit database (Year: 2007).*

English Machine translation of CN110173428A via USPTO Fit database on Oct. 17, 2024 (Year: 2019).*

English Machine translation of JP2007-100543A via USPTO Fit database on Oct. 17, 2024 (English Abstract) (Year: 2007).*

English Machine translation of JP2007-100543A via USPTO Fit database on Oct. 17, 2024 (Description) (Year: 2007).*

* cited by examiner

COMPRESSOR HAVING COMPRESSION SUBASSEMBLY AND METHODS OF ASSEMBLING THE SAME

FIELD

The field relates generally to scroll compressors, and more particularly, to scroll compressors including a subassembly that facilitates installing compressor components (e.g., scrolls, bearing housing, driveshaft) within the compressor as a single unit and aligning the compressor components in the compressor.

BACKGROUND

Scroll compressors compress refrigerant using a non-orbiting scroll member and an orbiting scroll member that cooperate to form sealed pockets therebetween. During operation of the scroll compressor, motion of the orbiting scroll member relative to the non-orbiting scroll member continuously changes the volume of the sealed pockets to compress refrigerant within.

Scroll compressors typically include one or more bearings which support rotation of a driveshaft and a drive bearing for transmitting rotational motion of the driveshaft to the orbiting motion of the scroll member. The drive bearing is housed in a main bearing housing and provided between a drive coupling of the orbiting scroll member and an eccentric body of the driveshaft. The drive bearing enables the eccentric body to rotate, applying a driving force to the drive coupling, such that the orbiting scroll member will orbit relative to the non-orbiting scroll member to effect compression of a fluid.

During operation, mis-alignment between the main bearing housing and the orbiting and non-orbiting scroll members may create the opportunity for the driveshaft to deflect under applied loads, which may lead to wear of compressor components (e.g., bearings). As demand increases for efficient and reliable operation of the compressor to ensure that the climate-control system in which the compressor is installed is capable of effectively and efficiently providing a cooling and/or heating effect on demand, the tolerances for mis-alignment between the main bearing housing and the scroll members continue to shrink. Furthermore, there is ongoing demand for ways to reduce the opportunity of wear on components, such as bearing assemblies, of the scroll compressor and increase the longevity of the compressor and the climate-control system. Accordingly, a need exists for an improved alignment structure that facilitates reducing the opportunity for mis-alignment between the main bearing housing and scroll members within the scroll compressor.

This background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect is a compressor that includes a compressor housing and a compression subassembly installed in the compressor housing. The compressor housing includes a shell defining a first chamber and an end cap defining a second chamber. The compression subassembly includes a support plate positioned in the compressor housing between the shell and the end cap, a non-orbiting scroll attached to the support plate and extending from the support plate into the first chamber, a main bearing housing positioned in the first chamber and attached to the non-orbiting scroll, and an orbiting scroll positioned between the non-orbiting scroll and the main bearing housing. The support plate separates the first chamber and the second chamber and the compression subassembly is supported in the compressor housing by the support plate.

Another aspect is a compression subassembly installable as a single unit in a compressor housing. The compression subassembly includes a support plate for supporting the compression subassembly in the compressor housing. The support plate includes an annular body, a central opening defined in the annular body, and an inner circumferential surface circumscribing the central opening. The compression subassembly also includes a non-orbiting scroll attached to the support plate. The non-orbiting scroll includes a raised portion extending into the central opening of the support plate, the raised portion defining a raised circumferential surface. The raised circumferential surface and the inner circumferential surface of the support plate are in sealing engagement. The compression subassembly also includes a main bearing housing attached to the non-orbiting scroll and an orbiting scroll positioned between the non-orbiting scroll and the main bearing housing.

Another aspect is a method of assembling a compressor. The method includes assembling a compression subassembly by attaching a non-orbiting scroll to a support plate, positioning an orbiting scroll on a surface of a main bearing housing, and attaching the main bearing housing to the non-orbiting scroll such that the orbiting scroll is positioned between the non-orbiting scroll and the main bearing housing. The method also includes installing the compression subassembly as a single unit in a first chamber defined by a shell of a compressor housing by positioning the support plate on the shell such that the compression subassembly is supported in the first chamber by the support plate, positioning an end cap of the compressor housing on the shell such that a second chamber is defined between the end cap and the shell, where the second chamber is separated from the first chamber by the support plate, and attaching the support plate and the end cap to the shell.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

The following figures illustrate various aspects of the disclosure.

Corresponding reference numerals indicate corresponding parts throughout the drawings.

DETAILED DESCRIPTION

Figure 1:
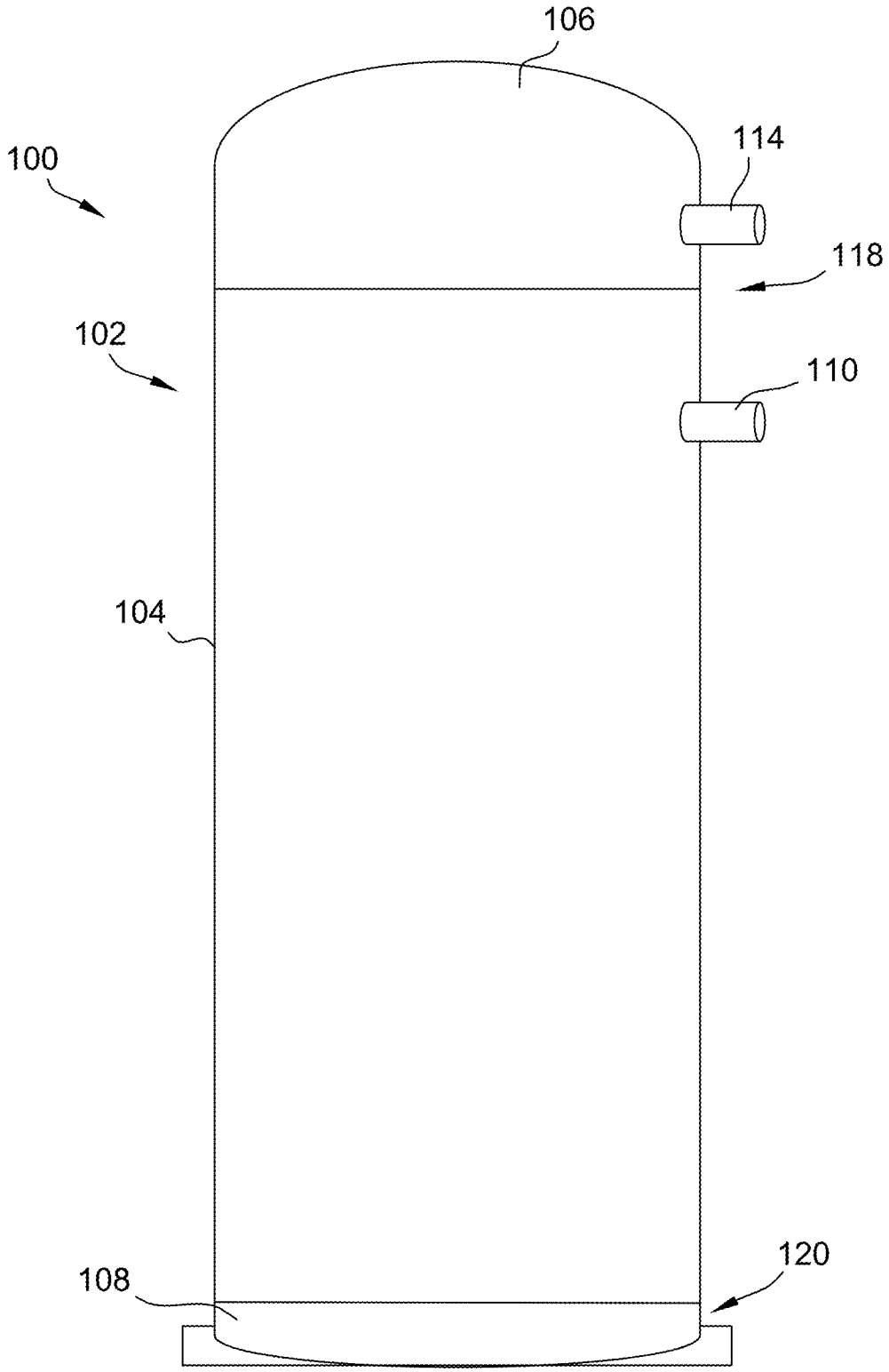
FIG. 1 is a schematic of a compressor.

Referring to FIG. 1, a schematic of a compressor is indicated generally at 100. Various components of the compressor 100 are omitted from FIG. 1 for convenience of illustration and description. The compressor 100 may include more components, fewer components, or other components than those shown and described with reference to FIG. 1. The compressor 100 includes a compressor housing 102 forming at least one sealed cavity within which refrigerant compression is accomplished. The compressor housing 102 includes a shell 104, an end cap 106 positioned at a first end 118 of the shell 104, and a base 108 positioned at an opposing second end 120 of the shell 104. In the illustrated example, the shell 104 is cylindrical in shape and the end cap 106 and the base 108 are each generally dome-shaped, such that the compressor housing 102 has a generally oval-shaped profile. The shell 104, the end cap 106, and/or the base 108 may be differently shaped depending on a desired shape and profile of the compressor housing 102. The end cap 106 and/or the base 108 may be attached at the respective ends 118, 120 of the shell 104 using any suitable means to join components. For example, the end cap 106 and/or the base 108 may be welded or bolted to the shell 104.

The compressor 100 includes an inlet fitting 110 attached to the compressor housing 102 at an inlet opening (not shown) through which working fluid (e.g., refrigerant) enters the at least one sealed cavity formed by the compressor housing 102. In the example compressor 100, the working fluid enters into a first chamber 112 (FIG. 2) defined by the shell 104 via the inlet fitting 110. The working fluid in the first chamber 112 is at suction pressure in the example compressor 100, and the first chamber 112 may alternatively be referred to as a suction chamber. In other embodiments, the working fluid in the first chamber 112 may be at discharge pressure. The inlet fitting 110 may be positioned at one or more different locations on the compressor housing 102 depending on the desired entry point of the working fluid within the at least one sealed cavity formed by the compressor housing 102. The working fluid is drawn into the compressor 100 via the inlet fitting 110 and compressed in the at least one sealed cavity. After the working fluid is compressed, the compressed working fluid exits the compressor 100 through a discharge opening (not shown). A discharge fitting 114 may be attached to the compressor housing 102 at the discharge opening. In the example compressor 100, the discharge opening in located on the end cap 106, and the discharge fitting 114 is attached to the end cap 106 at the discharge opening, to enable compressed working fluid to exit a second chamber 116 (FIG. 2) defined by the end cap 106. In the example compressor 100, the working fluid in the second chamber 116 is at discharge pressure, and the second chamber 116 may alternatively be referred to as a discharge chamber. A discharge valve assembly (not shown) may be disposed within the discharge fitting 114 to prevent a reverse flow condition. A hermetic electric terminal, not shown, may also be attached to the compressor housing 102, for example, to the shell 104.

Figure 2:
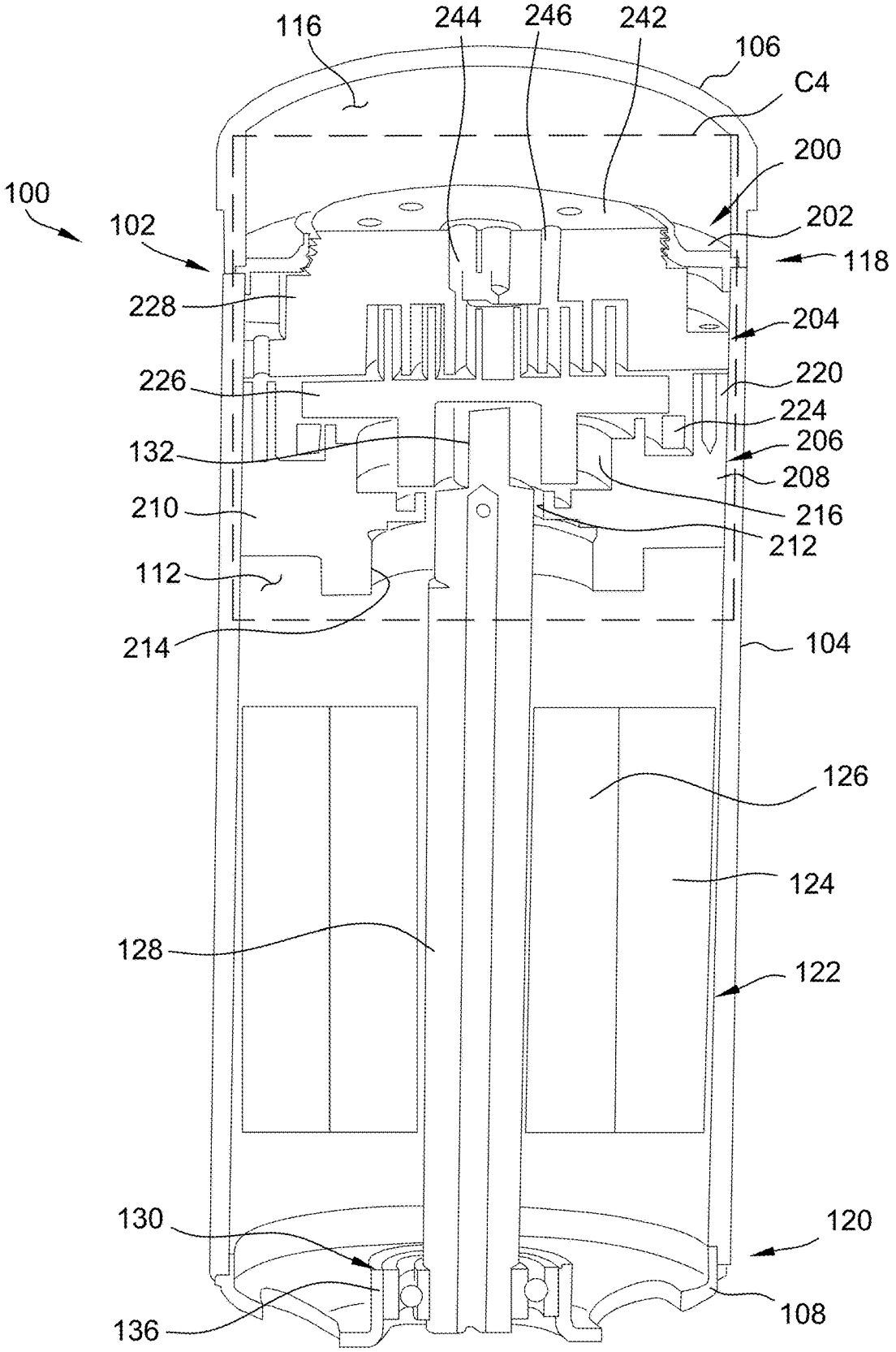
FIG. 2 is a cross-section of the compressor of FIG. 1 including a first example compression subassembly.
Figure 3:
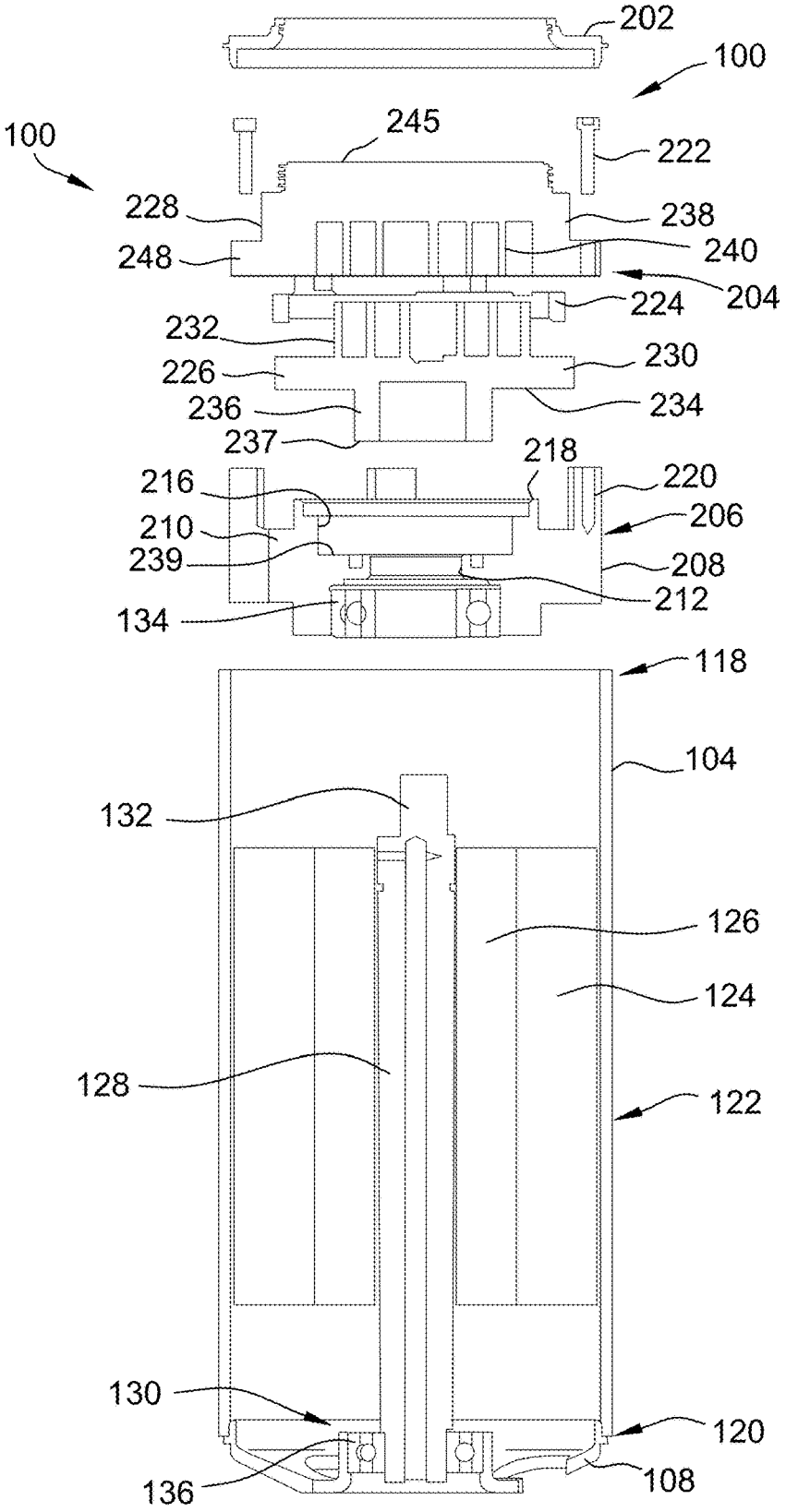
FIG. 3 is a partially exploded view of the cross-section shown in FIG. 2.

FIG. 2 is a cross-section of the compressor 100, and FIG. 3 is a partially exploded view of the cross-section shown in FIG. 2. Various components of the compressor 100 are omitted from FIGS. 2 and 3 for convenience of illustration and description. The compressor 100 may include more components, fewer components, or other components than those shown and described with reference to FIGS. 2 and 3. The compressor 100 includes the compressor housing 102 including the shell 104 defining the first chamber 112, the end cap 106 positioned at the first end 118 of the shell 104 and defining the second chamber 116, and the base 108 positioned at the second end 120 of the shell 104. The end cap 106 is omitted from FIG. 3. The compressor 100 also includes a motor assembly 122 and a first example compression subassembly, indicated generally at 200, installed in the compressor housing 102 and operably connected to the motor assembly 122.

The motor assembly 122 (shown schematically in FIGS. 2 and 3) includes a motor stator 124 and a rotor 126. The motor stator 124 may be press fit into the shell 104. The rotor 126 may be press fit on a driveshaft 128 positioned within the compressor housing 102 and may transmit rotational power to the driveshaft 128. The motor assembly 122 may be a variable-speed motor for rotating the driveshaft 128 at any of a plurality of speeds. In the illustrated embodiment, the motor assembly 122 is disposed within the shell 104. In some other embodiments, the compressor 100 may be an open drive compressor driven by a motor assembly 122 that is disposed outside of the compressor housing 102.

The driveshaft 128 is rotatably supported within a first bearing housing assembly 206 and second bearing housing assembly 130. The first bearing housing assembly 206 and the second bearing housing assembly 130 are axially displaced and located on opposite sides of the motor assembly 122. The first bearing housing assembly 206 is located proximate the first end 118 of the shell 104 and the second bearing housing assembly 130 is located proximate the second end 120 of the shell 104 (e.g., within the base 108). The driveshaft 128 extends through the first bearing housing assembly 206 and includes an eccentric body 132 extending axially beyond the first bearing housing assembly 206.

The first bearing housing assembly 206 includes a primary bearing 134 (shown in FIG. 3) and the second bearing housing assembly 130 includes a secondary bearing 136 (shown in FIGS. 2 and 3). The primary and secondary bearings 134, 136 rotationally support the driveshaft 128 within the respective bearing housing assembly 206, 130. The primary bearing 134 and/or the secondary bearing 136 may be rolling element bearings having an inner ring defining a bearing surface and bearing opening for receiving the driveshaft 128, an outer ring spaced radially outward from the inner ring, and a plurality of balls or rollers disposed between the inner ring and the outer ring. Where the primary bearing 134 and/or the secondary bearing 136 are rolling element bearings, the driveshaft 128 rotationally supported by the rolling element bearings 134 and/or 136 rotates with the inner ring. Alternatively, in some embodiments, the primary bearing 134 and/or secondary bearing 136 are journal bearings, and the driveshaft 128 rotationally supported by the journal bearings 134 and/or 136 within a bearing opening and relative to a stationary bearing inner surface. The primary bearing 134 and/or the secondary bearing 136 may be any suitable bearing type.

The compression subassembly 200 is installed in the compressor housing 102. Still referring to FIGS. 2 and 3, and with additional reference to FIG. 4, the compression subassembly 200 includes a support plate 202, a compression mechanism 204, and the first bearing housing assembly 206. The compression subassembly 200 may be pre-assembled and installed in the compressor housing 102 as a single unit. The compression subassembly 200 may include additional components that are positioned within the compressor housing 102, such as the driveshaft 128, for example.

The first bearing housing assembly 206 includes the primary bearing 134 and a main bearing housing 208. The main bearing housing 208 has a generally disk-shaped body 210 that includes a central bore 212 extending between a first annular pocket 214 and a second annular pocket 216. The first annular pocket 214 faces the motor assembly 122 and houses the primary bearing 134. The second annular pocket 216 is axially displaced from the first annular pocket 214 and faces the compression mechanism 204. The second annular pocket 216 is circumscribed by a thrust bearing surface 218 that supports the compression mechanism 204. The main bearing housing 208 also includes sleeve guides or bushings 220 that extend axially from a radial outer portion of the body 210 toward the compression mechanism 204. The bushings 220 define apertures 221 that receive fasteners 222 (e.g., screws or bolts), shown in FIG. 3, for attaching the main bearing housing 208 to the compression mechanism 204. A coupling 224, such as an Oldham coupling, is seated in an annular recess defined between the thrust bearing surface 218 and the bushings 220. The body 210 of the main bearing housing 208 may be suitably sized and shaped to be fixed within the shell 104 by press-fit. For example, the body 210 may define an outer diameter than is approximately equal to an inner diameter $D_4$ (FIG. 5) of the shell 104 such that, when the main bearing housing 208 is installed in the shell 104, the body 210 is press-fit against the shell 104. In other examples, the body 210 may have a smaller diameter than the shell 104 and is fixedly supported within the shell by other components of the compression subassembly 200 (e.g., the support plate 202).

The compression mechanism 204 includes an orbiting scroll 226 and a non-orbiting scroll 228. The orbiting scroll 226 includes a generally disk-shaped orbiting plate 230 defining opposing radial surfaces. An orbiting spiral wrap 232 extends axially from one of the radial surfaces of the orbiting plate 230, and the radial surface opposite the orbiting spiral wrap 232 defines a thrust surface 234 that engages the thrust bearing surface 218 of the main bearing housing 208 which supports the orbiting scroll 226. A cylindrical hub 236 extends axially from the thrust surface 234 and is received within the second annular pocket 216 of the main bearing housing 208. The cylindrical hub 236 is aligned with the central bore 212 of the main bearing housing 208. A radial surface 237 defined at an end of the cylindrical hub 236 may be supported by a second thrust bearing surface 239 defined in the second annular pocket 216 and circumscribing the central bore 212. A drive bushing (not shown) may be disposed in the cylindrical hub 236, and receives the eccentric body 132 of the driveshaft 128 that extends through the central bore 212 of the main bearing housing 208. The eccentric body 132 drivingly engages the drive bushing in the cylindrical hub 236 of the orbiting scroll 226, and facilitates transmitting rotational motion of the driveshaft 128 to orbiting motion of the orbiting scroll 226 relative to the main bearing housing 208 and/or the non-orbiting scroll 228. The annular pocket 216 is sized and shaped to enable orbiting movement of the cylindrical hub 236 therein. The bushings 220 of the main body housing 208 are located radially outward from the orbiting plate 230 so as not to limit or prevent orbiting motion of the orbiting scroll 226. The coupling 224 (e.g., an Oldham coupling) may be engaged with the orbiting scroll 226 and the main bearing housing 208 and/or the non-orbiting scroll 228 to limit or prevent relative rotation therebetween.

The non-orbiting scroll 228 includes a non-orbiting body 238 defining opposing radial surfaces 241, 243 and a circumferential edge extending between the radial surfaces 241, 243. A non-orbiting spiral wrap 240 is defined in one of the radial surfaces 241 of the body 238 and faces the orbiting spiral wrap 232. The non-orbiting scroll 228 also includes a raised portion 245 extending axially from the other one of the radial surfaces 243 of the non-orbiting body 238. The raised portion 245 defines an outer radial surface 242 of the non-orbiting scroll 228 raised relative to the radial surface 243 of the body 238. The radial surface 243 of the body 238 may also be referred to as a lower radial surface 243, relative to the outer radial surface 242. The outer radial surface 242 faces the second chamber 116 defined by the end cap 106.

The non-orbiting spiral wrap 240 engages, or meshes, the orbiting spiral wrap 232 of the orbiting scroll 226, defining a series of fluid pockets. Orbiting motion of the orbiting scroll 226 translates to movement of the fluid pockets defined by the spiral wraps 232 and 240, whereby the fluid pockets decrease in volume to compress working fluid in the fluid pockets. During a compression cycle of the compression mechanism 204, the fluid pockets defined by the spiral wraps 232 and 240 decrease in volume as orbiting motion of the orbiting scroll 226 translates to movement of the fluid pockets from a radially outer position (at a suction pressure) to a radially intermediate position (at an intermediate pressure) to a radially inner position (at a discharge pressure).

The non-orbiting scroll 228 includes at least one discharge port 244 extending from the spiral wrap 240, through the non-orbiting body 238 and the raised portion 245, to the outer radial surface 242. Each discharge port 244 is in communication with one of the fluid pockets defined by the spiral wraps 232 and 240 at the radially inner position and allows compressed working fluid (e.g., refrigerant) at the discharge pressure to flow into the second chamber 116 (e.g., a discharge chamber). The non-orbiting scroll 228 also includes at least one intermediate port 246 extending from the spiral wrap 240, through the non-orbiting body 238 and the raised portion 245, to the outer radial surface 242. Each intermediate port 246 is located radially outward from the at least one discharge port 244 and allows communication with one of the fluid pockets defined by the spiral wraps 232 and 240 at the radially intermediate position and/or the radially outer position from the outer radial surface 242. Flow of the working fluid through the intermediate ports 246 from a respective fluid pocket into the second chamber 116 may be regulated by a valve assembly (not shown) located at the outer radial surface 242. For example, a check valve (e.g., a reed valve) may be located at the outer radial surface 242 adjacent an intermediate port 246 to selectively permit or restrict flow of working fluid into the second chamber 116. Additionally and/or alternatively, one or more of the intermediate port(s) 246 may be a sensor port for receiving a sensor (e.g., a temperature sensor or a pressure sensor) for monitoring an operating parameter (e.g., temperature or pressure) within the respective fluid pocket during operation of the compression mechanism 204.

The non-orbiting scroll 228 is positioned over the orbiting scroll 226 and attached to the main bearing housing 208 such that the orbiting scroll 226 is moveably positioned between the non-orbiting scroll 228 and the main bearing housing 208. The orbiting scroll 226 is allowed to move radially between the non-orbiting scroll 228 and the main bearing housing 208, that is, in orbiting motion transmitted by the rotation driveshaft 128. The orbiting scroll 226 may also move axially, or "float," between the non-orbiting scroll 228 and the main bearing housing 208 during a compression cycle of the compression mechanism 204 to selectively enable or prevent the flow of working fluid at discharge pressure into the first chamber 112 (e.g., a suction chamber) and facilitate balancing pressure in response to a high discharge-to-suction pressure ratio in the compressor 100. For example, the orbiting plate 230 of the orbiting scroll 226 may define a bleed port (not shown) that enables working fluid to flow from one or more fluid pockets of the compression mechanism 204 into a volume of the first chamber 112 defined between the main bearing housing 208 and the orbiting scroll 226. This working fluid may be at a greater pressure (e.g., at intermediate pressure) than the first chamber 112 (e.g., suction pressure), and a pressure differential that exists between the intermediate pressure working fluid and suction pressure in the first chamber 112 may exert a net axial biasing force on the orbiting plate 230, urging the orbiting scroll 226 toward the non-orbiting scroll 228. When the pressure differential dissipates, the axial biasing force on the orbiting scroll 226 ceases and the orbiting scroll 226 moves axially away from the non-orbiting scroll 228. In examples where the orbiting scroll 226 floats between non-orbiting scroll 228 and the main bearing housing 208, the non-orbiting scroll 228 may be fixed within the compressor housing 102 (e.g., by attachment to the support plate 202) such that axial movement of the non-orbiting scroll 228 is limited or inhibited.

The bushings 220 of the main bearing housing 208 engage a flange 248 of the non-orbiting scroll 228 that extends radially outward from the circumferential edge of the non-orbiting body 238 proximate the non-orbiting spiral wrap 240. The flange 248 may be a unitary structure that has a continuous circumferential extent along the circumferential edge of the non-orbiting body 238, or the flange 248 may be discontinuous and formed by two or more discrete flange members. In some examples, the flange 248 is formed by multiple radially extending ears that each correspond to and engage one of the bushings 220 of the main bearing housing 208. The flange 248 may define a diameter that may be approximately equal to the inner diameter $D_4$ (FIG. 5) of the shell 104 or the flange 248 may define a smaller diameter than the inner diameter $D_4$.

Figure 4:
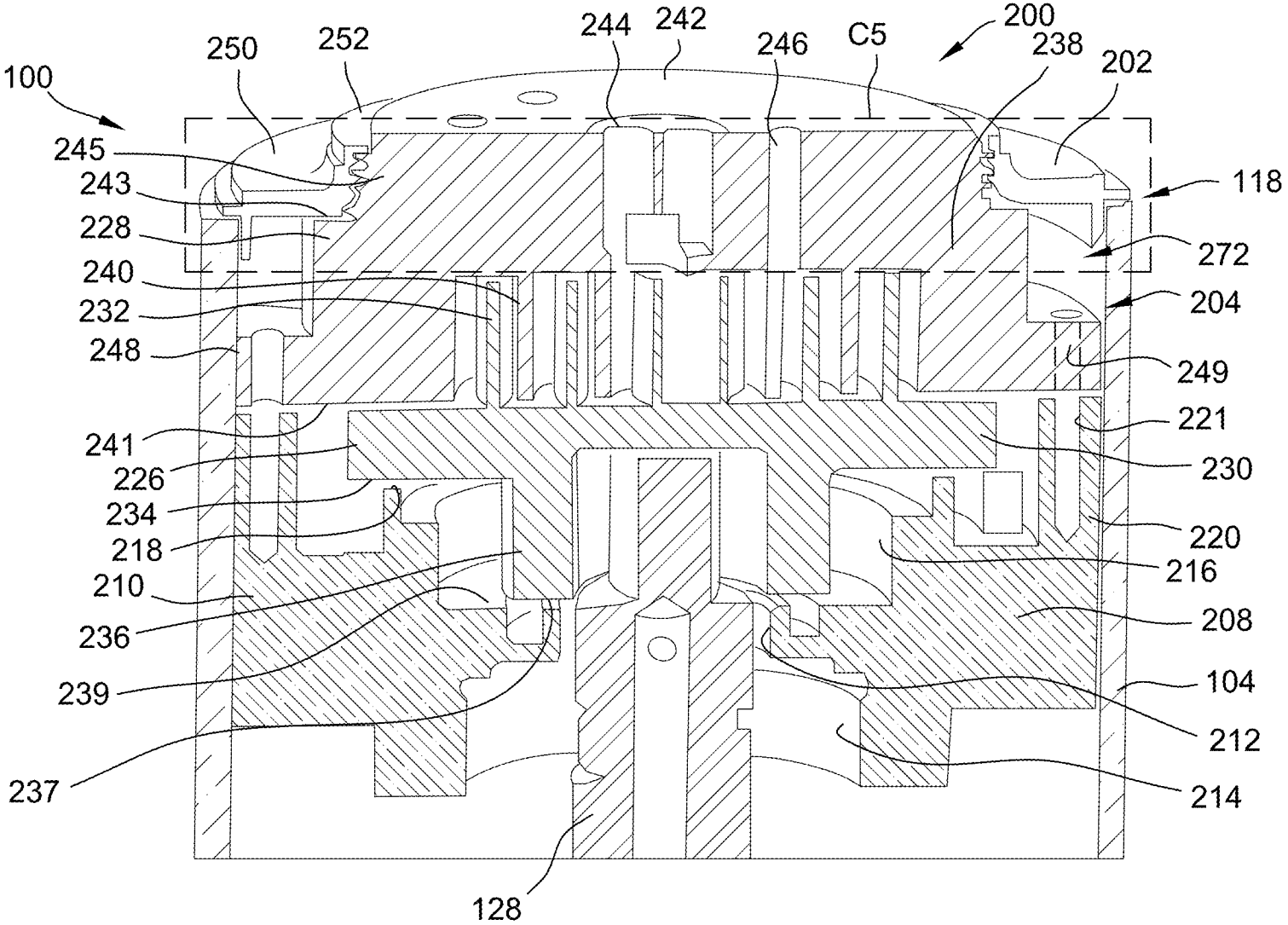
FIG. 4 is a magnified view of the cross-section shown in FIG. 2, indicated by the section $C_4$ in FIG. 2.

The flange 248 of the non-orbiting scroll 228 includes holes 249 extending axially through the flange 248. As shown in FIG. 4, each hole 249 corresponds to an aperture 221 of one of the bushings 220. Each pair of a hole 249 and corresponding aperture 221 receives one of the fasteners 222 therethrough to attach the non-orbiting scroll 228 to the main bearing housing 208 with the orbiting scroll 226 moveably positioned therebetween. The holes 249 and corresponding apertures 221 may, in some examples, be differently dimensioned (e.g., sized and/or shaped) from the other holes 249 and corresponding apertures 221 such that the non-orbiting scroll 228 can only be attached to the main bearing housing 208 when the non-orbiting scroll 228 has a certain position and orientation relative to the main bearing housing 208. The differently sized and/or shaped holes 249 and corresponding apertures 221 may facilitate ensuring that the orbiting scroll 226 and the non-orbiting scroll 228 consistently have a desired position and orientation in the compressor housing 102 relative to the main bearing housing 208 when the compression subassembly 200 is installed.

The non-orbiting scroll 228 is attached to the support plate 202 which separates the first chamber 112 (e.g., a suction chamber) from the second chamber 116 (e.g., a discharge chamber). The support plate 202 supports the compression subassembly 200 within the compressor housing 102. The support plate 202 is positioned in the compressor housing 102 between the end cap 106 and the shell 104, as shown in FIG. 2. The support plate 202 includes an annular body 250 and a central opening 252 defined in the annular body 250. The annular body 250 extends between and is attached to each of the non-orbiting scroll 228 and the shell 104. The annular body 250 and the non-orbiting scroll 228 cooperatively seal the first chamber 112 from the second chamber 116, that is, the attachment between the annular body 250 and the non-orbiting scroll 228 creates a seal that facilitates limiting or preventing working fluid from leaking into the second chamber 116 from the first chamber 112, and/or into the first chamber 112 from the second chamber 116, between the annular body 250 and the non-orbiting scroll 228.

The annular body 250 and the shell 104 also cooperatively seal the first chamber 112 from the second chamber 116 by the attachment between the annular body 250 and the shell 104. In the illustrated embodiment, the annular body 250 of the support plate 202 is solid and does not include openings through which working fluid can flow. As such, the annular body 250 separates the first chamber 112 from the second chamber 116 and maintains a pressure differential between the second chamber 116 and the first chamber 112, which may be suitable in low-side compressor applications (e.g., where the first chamber 112 is a suction chamber and the second chamber 116 is a discharge chamber). In other examples, such as where the compressor 100 is a high-side compressor, the working fluid in the first chamber 112 and the second chamber 116 may be at a same pressure (e.g., discharge pressure), and the annular body 250 may include pass-through features (e.g., holes) that allow working fluid to flow though the annular body between the first chamber 112 and the second chamber 116.

The raised portion 245 of the non-orbiting scroll 228 extends into the central opening 252 defined in the annular body 250 of the support plate 202. The outer radial surface 242 defined by the raised portion 245 is accessible via the central opening 252. As such, the at least one intermediate port 246 in communication with the fluid pockets of the compression mechanism 204 may be accessible through the central opening 252. Advantageously, the intermediate port(s) 246, which, as described above, may be a sensor port and/or may be associated with a valve assembly (e.g., a reed valve) for regulating flow of working fluid therethrough, are accessible without having to remove the support plate 202 and/or otherwise disassemble the compression subassembly 200.

With additional reference to FIGS. 5-7, the support plate 202 and its attachment to the non-orbiting scroll 228 and the shell 104 will now be described in greater detail. The annular body 250 of the support plate 202 has a first radial surface 254 and a second radial surface 256. When the compression subassembly 200 is installed in the compressor housing 102, the first radial surface 254 faces the second chamber 116 and the second radial surface 256 faces the compression mechanism 204 and the first chamber 112. The support plate 202 also includes a collar 258 extending axially from the first radial surface 254 at the central opening 252. The collar 258 defines an inner circumferential surface 260 of the support plate 202 that circumscribes the central opening 252. Tapered threads 262 are formed on the inner circumferential surface 260. The collar 258 also has an outer circumferential surface 264 extending from the first radial surface 254.

Figure 5:
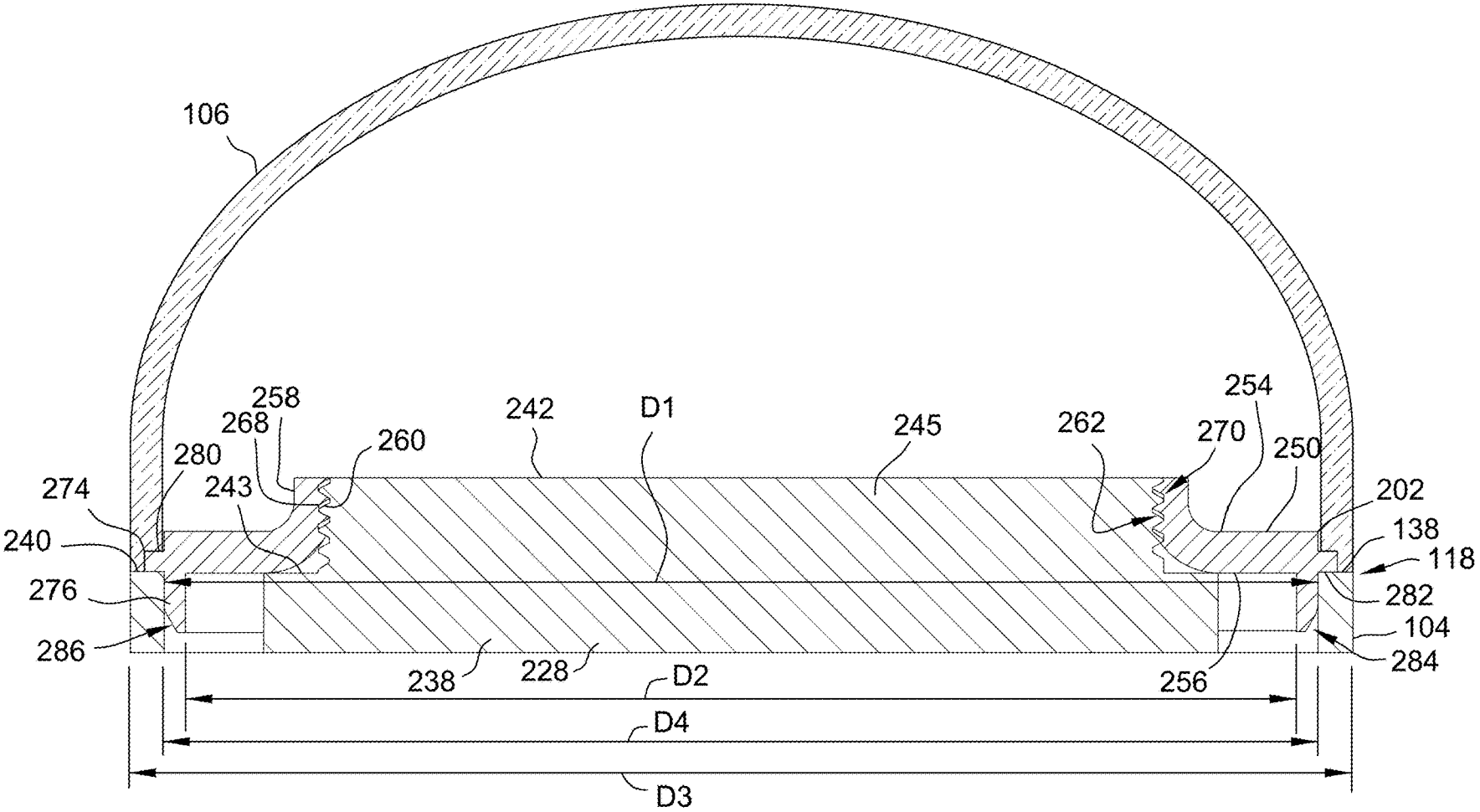
FIG. 5 is a magnified view of the cross-section shown in FIG. 4, indicated by the section $C_5$ in FIG. 4.

As shown in FIG. 5, the raised portion 245 of the non-orbiting scroll 228 defines a raised circumferential surface 268 that engages the inner circumferential surface 260 of the support plate 202 in the central opening 252. In particular, tapered threads 270 are formed on the raised circumferential surface 268, and the tapered threads 270 complement the tapered threads 262 formed on the inner circumferential surface 260 of the support plate 202. The threads 262 and 270 threadedly engage one another to attach the non-orbiting scroll 228 to the support plate 202. The threaded engagement between the raised circumferential surface 268 of the non-orbiting scroll 228 and the inner circumferential surface 260 of the support plate 202 also creates a seal that, with the annular body 250 and the shell 104 limits or prevents working fluid from flowing between the first chamber 112 and the second chamber 116. One or more flats 266 may be defined in the outer circumferential surface 264 to facilitate gripping and tightening the support plate 202 onto the non-orbiting scroll 228. When the support plate 202 is completely threaded onto the non-orbiting scroll 228, the second radial surface 256 may engage the radial surface 243 of the non-orbiting body 238 proximate the central opening 252. The radial surface 243 of the non-orbiting body 238 may act as a stop for the threaded engagement between the support plate 202 and the non-orbiting scroll 228, and engagement between the radial surface 243 and the second radial surface 256 facilitates ensuring that the support plate 202 can be repeatedly and consistently tightened to an appropriate depth on the non-orbiting scroll 228.

Figure 6:
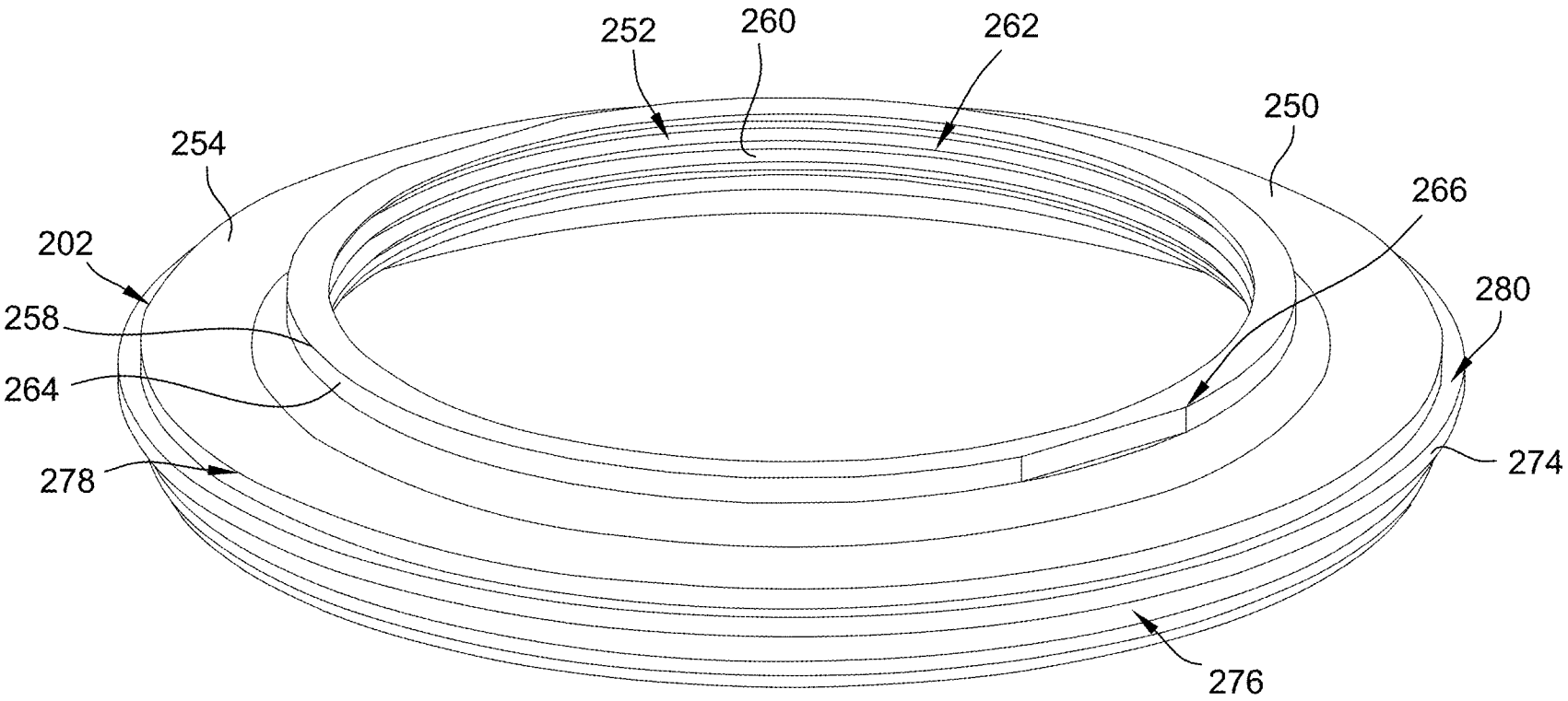
FIG. 6 is a top perspective of a support plate of the first example compression subassembly shown in FIGS. 2-5.
Figure 7:
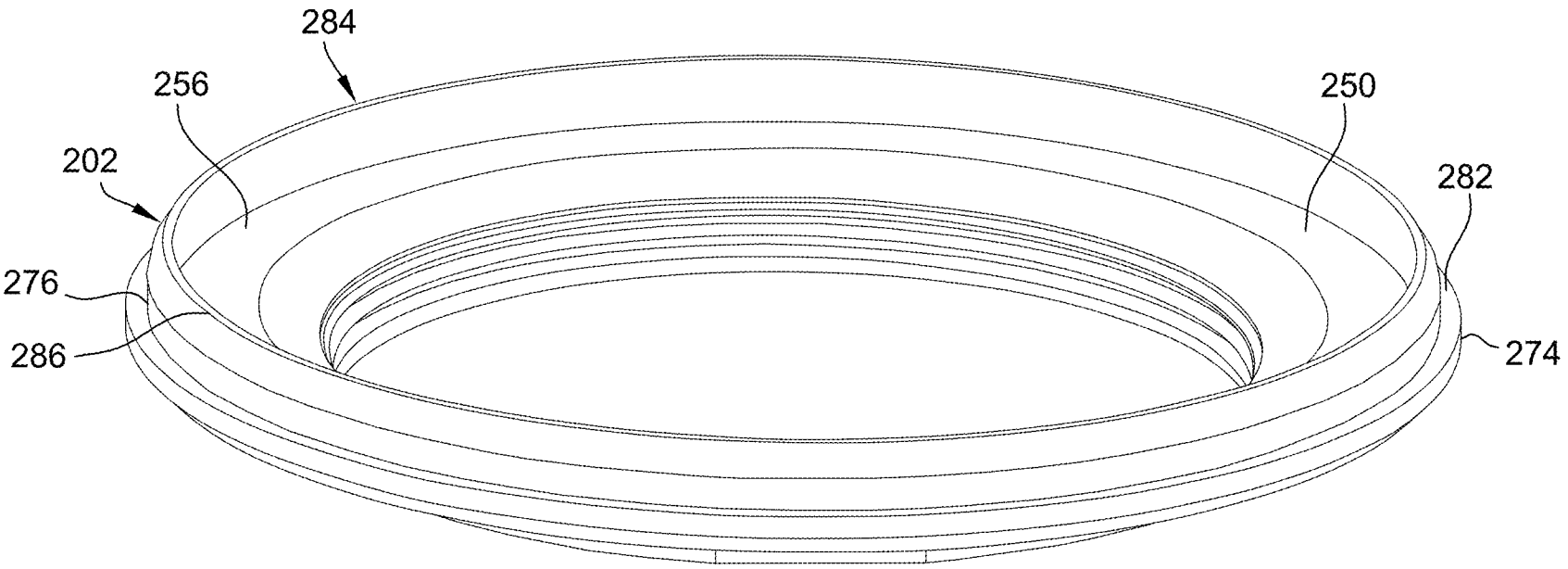
FIG. 7 is a bottom perspective of the support plate shown in FIG. 6.

Still referring to FIGS. 5-7, the support plate 202 includes a first flange member 274 and a second flange member 276. The first flange member 274 extends radially from an outer radial edge 278 of the annular body 250. The first flange member 274 is stepped from the outer radial edge 278, defining a stepped surface 280 and a stop surface 282 opposite the stepped surface 280. The second flange member 276 extends axially from the second radial surface 256 of the annular body 250, and separates the second radial surface 256 and the stop surface 282 of the first flange member 274. The second flange member 276 is generally cylindrical in shape, complementing the annular shape of the body 250 of the support plate 202. The second flange member 276 has a first outer diameter $D_1$ proximate the second radial surface 256. The second flange member 276 extends to a leading end 284. The second flange member 276 has a second outer diameter $D_2$ at the leading end 284 which is smaller than the first outer diameter $D_1$. The reduced outer diameter $D_2$ may be provided by a chamfered outer edge 286 at the leading end 284 of the second flange member 276.

When the compression subassembly 200 is installed in the compressor housing 102, the stop surface 282 of the first flange member 274 is seated on a rim 138 of the shell 104 located at the first end 118. The stop surface 282 and the rim 138 may be shaped (e.g., machined) to provide complementing surfaces (e.g., complementing flat surfaces). The complementing surfaces of the rim 138 and stop surface 282 may facilitate balancing the support plate 202 on the rim 138 and centering the compression subassembly 200 within the compressor housing 102. The stop surface 282 facilitates locating the support plate 202 on the shell 104 and the first flange member 274 enables the support plate 202 to be attached to the rim of the shell 104. The stop surface 282 also facilitates controlling the depth into the shell 104 that the support plate 202 extends, as well as overall alignment of the compression subassembly 200. The first flange member 274 may be attached to the shell 104 using any suitable means to join components. For example, the first flange member 274 may be welded to the shell 104. The connection (e.g., a welded connection) between the first flange member 274 and the shell 104 may suitably create a seal that facilitates limiting or preventing working fluid from leaking between the second chamber 116 and the first chamber 112.

As shown in FIG. 5, the shell 104 has an outer diameter $D_3$ that is greater than an outer diameter defined by the first flange member 274. As such, the first flange member 274 terminates prior to an outer radial edge of the rim 138 of the shell 104, and an outer portion 140 of the rim 138 extends radially beyond the first flange member 274. The outer portion 140 of the rim 138 may provide an exposed surface on which the end cap 106 may be seated and attached to the rim 138, such that the end cap 106 circumscribes the first flange member 274. A bottom edge of the end cap 106 that is seated on the rim 138 may also be shaped (e.g., machined) to complement a shape defined the stepped surface 280 of the first flange member 274 and the outer portion 140 of the rim 138. For example, the stepped surface 280 and the outer portion 140 may define an "L"-shape, and the bottom edge of the end cap 106 may be machined to have a complementing L-shape to facilitate positioning and balancing the end cap 106 on the rim 138 with the support plate 202 positioned between the end cap 106 and the rim 138. The support plate 202 and the end cap 106 may each be attached to the rim 138 of the shell 104 using any suitable means to join components. The support plate 202 and the end cap 106 may be attached to the rim 138 via a single attaching operation or successive attaching operations. For example, the support plate 202 and the end cap 106 may be attached to the shell 104 by welding, separately or in a single welding operation. Alternatively, one or both the support plate 202 and the end cap 106 may be attached to the rim 138 by another suitable attaching means (e.g., bolts).

When the compression subassembly 200 is installed in the compressor housing 102, the second flange member 276 is received by the rim 138 of the shell 104. The second flange member 276 facilitates centering the support plate 202 on the shell 104. The outer diameter $D_1$ of the second flange member 276 proximate the second radial surface 256 may be approximately equal to an inner diameter $D_4$ of the shell 104 such that the second flange member 276 is press-fit within the shell 104, which may enable the support plate 202 to be more easily centered on the shell 104 for aligning the compression subassembly 200 within the compressor housing 102. The chamfered outer edge 286 at the leading end 284 of the second flange member 276, which provides the reduced outer diameter $D_2$ of the second flange member 276 at the leading end 284, may facilitate piloting the second flange member 276 into the shell 104 before the second flange member 276 engages the shell 104 by press-fit at the outer diameter $D_1$ proximate the second radial surface 256.

Referring again to FIG. 4, in the example compressor 100, a fluid cavity 272 is defined between the main bearing housing 208 and the support plate 202. The fluid cavity 272 may be defined by the separate fastening mechanisms for attaching the non-orbiting scroll 228 to the support plate 202 and the main bearing housing 208, that is, the threaded attachment of the non-orbiting scroll 228 to the support plate 202 and the separate attachment of the non-orbiting scroll 228 to the main bearing housing 208 with the fasteners 222, as well as a radial displacement between the non-orbiting body 238 and the shell 104. As such, the fluid cavity 272 surrounds the non-orbiting body 238 between the main bearing housing 208 and the support plate 202. This fluid cavity 272 is located within the first chamber 112 and working fluid within the fluid cavity is at the same pressure as the first chamber 112 (e.g., suction pressure). The fluid cavity 272 is also located adjacent the second chamber 116 (FIG. 2), and is separated from the second chamber by the support plate 202. The seals created by the attachment of the non-orbiting scroll 228 to the support plate 202 (e.g., via a threaded attachment) and the first flange member 274 and the shell 104 (e.g., via a welded connection) suitably facilitate limiting or preventing working fluid from flowing directly between the fluid cavity 272 and the second chamber 116.

Figure 8:
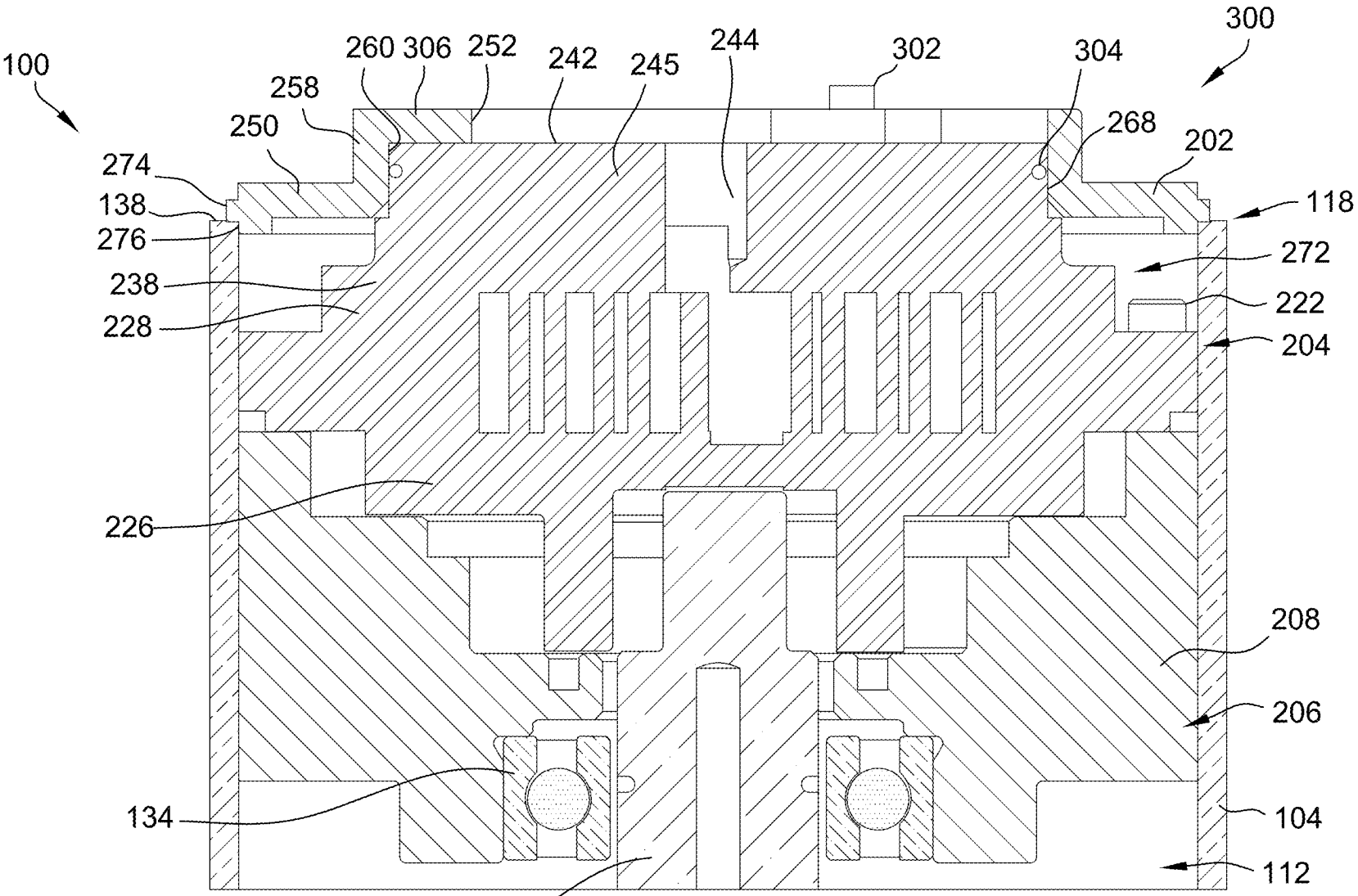
FIG. 8 is a partial cross-section of the compressor of FIG. 1, showing a second example compression subassembly of the compressor.

FIG. 8 is a magnified cross-section of a portion of the compressor 100, similar to FIG. 4, showing another example compression subassembly, indicated generally at 300, installed in the compressor housing 102. The compression subassembly 300 includes similar features and components as the compression subassembly 200 shown and described above with reference to FIGS. 2-7. Corresponding reference numerals are used to indicate corresponding parts between the compression subassembly 300 and the compression subassembly 200. Like the compression subassembly 200, the compression subassembly 300 includes the support plate 202 positioned on the shell 104 and attached to the rim 138, the compression mechanism 204 that includes the orbiting scroll 226 and the non-orbiting scroll 228 attached to the support plate 202, and the main bearing housing 208 attached to the non-orbiting scroll 228 by fasteners 222 as described above. The fluid cavity 272 is defined between the main bearing housing 208 and the support plate 202 as described above and sealed from the second chamber 116 (FIG. 2) by the attachment between the support plate 202 and the non-orbiting scroll 228 and the attachment between the support plate 202 and the rim 138 of the shell 104.

In the compression subassembly 300 of FIG. 8, the support plate 202 is attached to the outer radial surface 242 of the non-orbiting scroll 228 with fasteners 302 (e.g., screws or bolts). As described above, the raised portion 245 of the non-orbiting scroll 228 extends into the central opening 252 and the raised circumferential surface 268 engages the inner circumferential surface 260 of the support plate 202 defined by the collar 258. In this example, the circumferential surfaces 260, 268 are not threaded, and an O-ring 304 is positioned between the circumferential surfaces 260, 268. Engagement between the circumferential surfaces 260, 268 when the support plate 202 is attached to the outer radial surface 242 compresses the O-ring 304 which creates a seal that facilitates limiting or preventing working fluid from flowing between the second chamber 116 and the fluid cavity 272 defined in the first chamber 112. The support plate 202 includes brackets 306 that extend radially inward from the collar 258, over the outer radial surface 242 of the non-orbiting scroll 228. Three brackets 306 are included in the example embodiment, but more or fewer brackets 306 may be included. The brackets 306 include holes (not shown) defined therein that correspond to apertures (not shown) defined in the outer radial surface 242. The fasteners 302 are received by the holes in the brackets 306 and the corresponding apertures in the outer radial surface 242 to attach the support plate 202 to the non-orbiting scroll 228.

Figure 9:
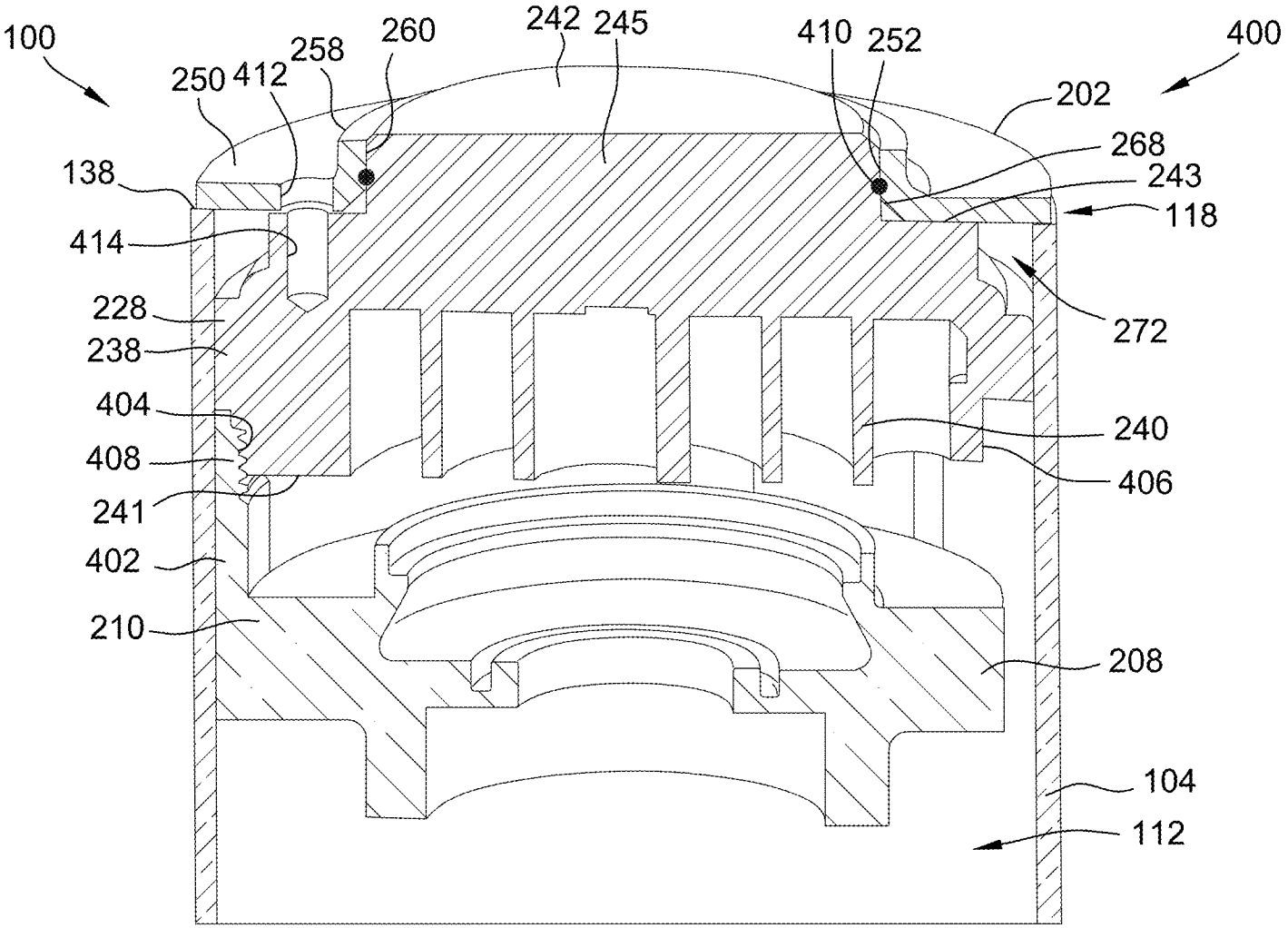
FIG. 9 is a partial cross-section of the compressor of FIG. 1, showing a portion of third example compression subassembly of the compressor.

FIG. 9 is a magnified cross-section of a portion of the compressor 100, similar to FIG. 4, showing a portion of another example compression subassembly, indicated generally at 400, installed in the compressor housing 102. The compression subassembly 400 includes similar features and components as the compression subassembly 200 shown and described above with reference to FIGS. 2-7 and the compression subassembly 300 shown and described above with reference to FIG. 8. Corresponding reference numerals are used to indicate corresponding parts between the compression subassembly 400 and the compression subassembly 200 and/or the compression subassembly 300. Like the compression subassembly 200 and 300, the compression subassembly 400 includes the support plate 202 positioned on the shell 104 and attached to the rim 138, the compression mechanism 204 that includes the orbiting scroll 226 (omitted from FIG. 9) and the non-orbiting scroll 228 attached to the support plate 202, and the main bearing housing 208 attached to the non-orbiting scroll 228.

In the compression subassembly 400 of FIG. 9, the fluid cavity 272 is defined between the non-orbiting body 238 of the non-orbiting scroll 228 and the support plate 202, and the non-orbiting body 238 is threadedly attached to the main bearing housing 208 opposite the fluid cavity 272. The bushings 220 are not included in the main bearing housing 208, and the main bearing housing 208 includes stakes 402 that extend axially from a radial outer portion of the body 210 toward the non-orbiting scroll 228. Inner threads 404 are formed on the stakes 402 proximate an axial end of the stakes 402 opposite the body 210. The non-orbiting body 238 includes a recess 406 defined in the circumferential edge adjacent the radial surface 241. The recess 406 defined in the non-orbiting body 238 corresponds to and receives the stakes 402 of the main bearing housing 208. Outer threads 408 are formed along a recessed circumferential surface of the body 238 defined by the recess 406. The outer threads 408 complement the inner threads 404 of the stakes 402. The threads 404 of the stakes 402 engage the threads 408 of the recessed circumferential edge of the body 238 to threadedly attach the body 238 to the main bearing housing 208.

Still referring to FIG. 9, in the compression subassembly 400, the annular body 250 of the support plate 202 is attached to the non-orbiting body 238 of the non-orbiting scroll 228 with fasteners (not shown), such as screws or bolts for example. As described above, the raised portion 245 of the non-orbiting scroll 228 extends into the central opening 252 and the raised circumferential surface 268 engages the inner circumferential surface 260 of the support plate 202 defined by the collar 258. In this example, similar to the compression subassembly 300, the circumferential surfaces 260, 268 are not threaded, and an O-ring 410 is positioned between the circumferential surfaces 260, 268. Engagement between the circumferential surfaces 260, 268 when the support plate 202 is attached to the outer radial surface 242 compresses the O-ring 410 which creates a seal that facilitates limiting or preventing working fluid from flowing between the second chamber 116 (FIG. 2) and the fluid cavity 272 defined in the first chamber 112. The annular body 250 of the support plate 202 includes holes 412 that correspond to apertures 414 defined in the radial surface 243 of the non-orbiting body 238. The fasteners are received by the holes 412 and the corresponding apertures 414 to attach the support plate 202 to the non-orbiting scroll 228.

Figure 10:
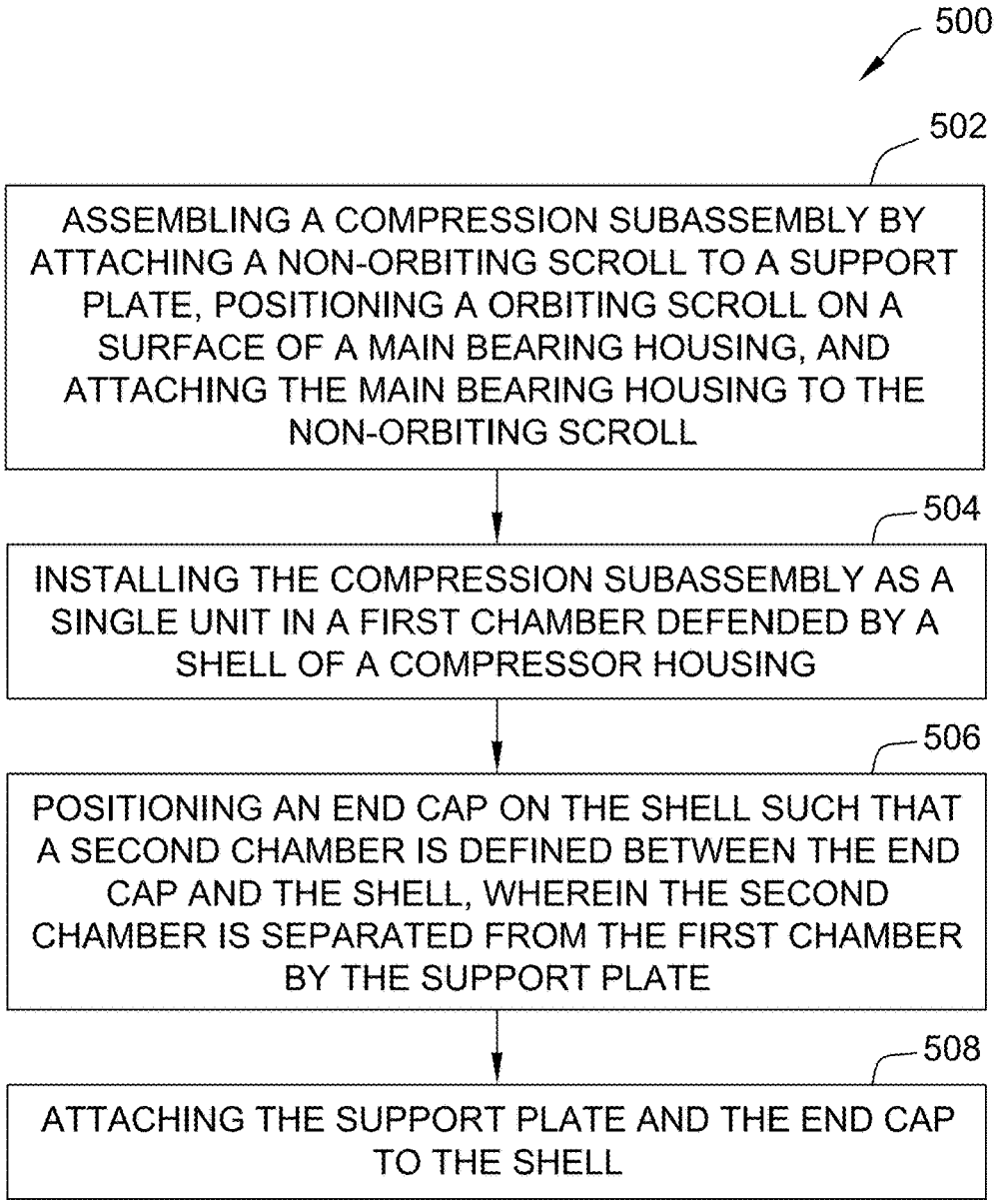
FIG. 10 is an example method of assembling a compressor that includes installing a compression subassembly as a single unit.

Referring to FIGS. 1-9, and with additional reference to FIG. 10, an example method 500 of assembling a compressor (e.g., the compressor 100) that includes installing a compression subassembly (e.g., the compression subassembly 200, 300, and/or 400) as a single unit in a housing of the compressor (e.g., the compressor housing 102) will now be described. The method includes assembling 502 the compression subassembly, which includes the support plate 202, the orbiting scroll 226, the non-orbiting scroll 228, and the main bearing housing 208. Assembling 502 the compression subassembly may include attaching the non-orbiting scroll 228 to the support plate 202. The non-orbiting scroll 228 may be threadedly attached to the support plate 202 (as in the compression subassembly 200 shown in FIGS. 2-7), or may be attached to the support plate 202 with fasteners (as in the compression subassembly 300 shown in FIG. 8 or the compression subassembly 400 shown in FIG. 9). The attachment between the non-orbiting scroll 228 and the support plate 202 suitably creates a seal, for example, by a mechanical seal between complementing tapered threads or by O-rings that compress between engaging surfaces of the non-orbiting scroll 228 and the support plate 202 when attached. Assembling 502 the compression subassembly may also include positioning the orbiting scroll 226 on a surface of the main bearing housing 208 (e.g., one or both of the thrust bearing surfaces 218 and 239). Assembling 502 the compression subassembly may also include attaching the main bearing housing 208 to the non-orbiting scroll 228. The non-orbiting scroll 228 may be attached to the main bearing housing 208 with fasteners (as in the compression subassembly 200 shown in FIGS. 2-7 or the compression subassembly 300 shown in FIG. 8), or may be threadedly attached to the main bearing housing 208 (as in the compression subassembly 400 shown in FIG. 9). Suitably, the orbiting scroll 226 is positioned on the surface of the main bearing housing 208 prior to attaching the main bearing housing 208 to the non-orbiting scroll 228, such that the orbiting scroll is positioned between the non-orbiting scroll and the main bearing housing. The compression subassembly may also include a driveshaft of the compressor 100 (e.g., the driveshaft 128). In these examples, assembling 502 the compression subassembly further includes connecting the driveshaft 128 to the orbiting scroll 226, for example, by inserting the driveshaft 128 through the central bore 212 of the main bearing housing 208 and connecting the eccentric body 132 of the driveshaft 128 with the drive bushing disposed in the cylindrical hub 236 of the orbiting scroll 226.

Once the compression subassembly is assembled 502, the compression subassembly may be installed 504 in a first chamber of the compressor housing 102 as a pre-assembled, single unit. For example, the compression subassembly may be installed 504 in the first chamber 112 defined by the shell 104 of the compressor housing 102. Installing 504 the compression subassembly in the compressor housing may include inserting the main bearing housing 208, the orbiting scroll 226, and the non-orbiting scroll 228 into the first chamber 112 and positioning the support plate 202 on the shell 104. The compression subassembly is supported in the first chamber 112 by the support plate 202. For example, the compression subassembly may be suspended from or "hang" from the support plate 202, which is centered and fixedly positioned on the shell 104 to facilitate aligning the compression subassembly within the shell 104. The driveshaft 128 may optionally be inserted into the first chamber 112 and supported by the support plate 202 if the driveshaft 128 is assembled 502 as part of the compression subassembly.

As described above with reference to FIGS. 5-7, the support plate 202 may include the first flange member 274 that defines the stop surface 282, which is seated on the rim 138 of the shell 104 when the compression subassembly is installed 504 in the compressor housing 102. The stop surface 282 and the rim 138 may be machined to include complementing surfaces (e.g., complementing flat surfaces) that facilitate balancing the support plate 202 on the rim 138 and centering the compression subassembly within the compressor housing 102. The first flange member 274 extends at least partially across the rim 138 of the shell 104, to enable attaching the support plate 202 to the rim 138. The first flange member 274 may terminate prior to an outer portion 140 of the rim 138 which may provide an exposed surface on which the end cap 106 may be seated and attached to the rim 138, as described above. The support plate 202 may also include the second flange member 276 that is received by the rim 138 of the shell 104 when the compression subassembly is installed 504 in the compressor housing 102. The second flange member 276 may facilitate piloting the compression subassembly into the compressor housing during the installing 504 and/or centering the compression subassembly within the shell 104, as described above.

With the compression subassembly installed 504 in the first chamber 112, an end cap (e.g., the end cap 106) of the compressor housing 102 may be positioned 506 on the shell 104 such that a second chamber (e.g., the second chamber 116) is defined between the end cap 106 and the shell 104. The support plate 202 is positioned between the end cap 106 and the shell 104 and separates the first chamber and the second chamber. The support plate 202 and the end cap 106 may then be attached 508 to the shell 104, separately or in a single attaching operation. For example, the support plate 202 and the end cap 106 may be attached 508 to the shell 104 by welding, separately or in a single welding operation. Alternatively, one or both the support plate 202 and the end cap 106 may be attached 508 to the rim 138 by another suitable attaching means (e.g., bolts).

When the compressor is assembled by the method 500, including the compression assembly installed 504 in the compressor housing, the main bearing housing 208 and/or the non-orbiting scroll 228 may be press-fit against the shell 104 or may be radially displaced from the shell. Press-fit between the main bearing housing 208 and/or the non-orbiting scroll 228 may not be required for installing 504 the compression subassembly and supporting the compression subassembly within the compressor housing because the support plate 202 attached to the shell 104 facilitates centering and supporting the compression subassembly within the shell 104. Gaps that exist between the shell 104 and the main bearing housing 208 and/or the non-orbiting scroll 228 installed 504 in the compressor housing 102 may result in the fluid cavity 272 being at the same pressure as the first chamber 112 (e.g., suction pressure). Suitably, the seals created by the attachment of the non-orbiting scroll 228 to the support plate 202 and the attachment of the support plate 202 to the shell 104 facilitate limiting or preventing working fluid from flowing directly between the fluid cavity 272 and the second chamber 116, which may be at a different pressure than the fluid cavity (e.g., discharge pressure).

Embodiments described achieve superior results as compared to prior compressors. In particular, the compression subassemblies described herein facilitate installing and aligning compressor components (e.g., scrolls, bearings, driveshaft) within a compressor housing. Example compression subassemblies include a support plate attached to a non-orbiting scroll that is in turn attached to a main bearing housing with an orbiting scroll positioned therebetween. The support plate separates chambers of the compressor housing that may be at different pressures and creates fluid-tight seals to limit or prevent working fluid from leaking between the chambers. The attachment between the support plate and the non-orbiting scroll allows for the compression subassembly to be assembled and installed in the compressor housing as a single unit. A compression subassembly may be suspended from, or "hang," within the compressor housing from the support plate, and the support plate includes stop and/or locating features for positioning and centering the support plate on a shell of the compressor housing to provide superior alignment of the compression subassembly therein. In at least some known compressors, the compressor components are installed separately and the compressor housing is used as a primary datum point for the separate connections between the compressor components. Each successive connection between compressor components in these known compressors increases tolerance stack and the opportunity for mis-alignment between compressor components. The example compression subassemblies described provide improvements over known compressors by providing an alignment structure for multiple compressor components that relies only on a single connection point between the support plate and the compressor housing for aligning the components, thus facilitating reducing or eliminating the opportunity for alignment errors.

When introducing elements of the present disclosure or the embodiment(s) thereof, the articles "a", "an", "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A compressor comprising:

a compressor housing comprising a shell defining a first chamber and an end cap defining a second chamber; and a compression subassembly installed in the compressor housing, the compression subassembly comprising:

a support plate positioned in the compressor housing between the shell and the end cap, wherein the support plate comprises an annular body separating the first chamber and the second chamber, the annular body having an inner circumferential surface defining a central opening, wherein the support plate comprises a radially-extending flange member stepped from an outer radial edge of the annular body, wherein the radially-extending flange member is seated on and attached to a rim of the shell, and an axially-extending flange member received by the rim to center the support plate on the shell, and wherein the radially-extending flange member terminates prior to an outer radial edge of the rim, wherein the end cap is seated on and attached to the rim of the shell and the end cap circumscribes the radially-extending flange member;

a non-orbiting scroll attached to the support plate and extending from the support plate into the first chamber, wherein the non-orbiting scroll comprises a raised portion extending into the central opening of the support plate, the raised portion defining a raised circumferential surface, wherein the raised circumferential surface and the inner circumferential surface of the support plate are in sealing engagement and comprise complementing threads for threadedly engaging one another;

a main bearing housing positioned in the first chamber and attached to the non-orbiting scroll; and an orbiting scroll positioned between the non-orbiting scroll and the main bearing housing;

wherein the compression subassembly is supported in the compressor housing by the support plate.

2. The compressor of claim 1, wherein the support plate and the non-orbiting scroll cooperatively seal the first chamber from the second chamber.

3. The compressor of claim 1, wherein an outer radial surface of the non-orbiting scroll is accessible via the central opening of the annular body.

4. The compressor of claim 1, wherein the support plate comprises a collar circumscribing the central opening and defining the inner circumferential surface and an outer circumferential surface, and wherein a flat is defined in the outer circumferential surface.

5. The compressor of claim 1, wherein the non-orbiting scroll is attached to the main bearing housing with fasteners.

6. The compressor of claim 1, wherein the raised portion of the non-orbiting scroll extends from a lower radial surface, wherein the lower radial surface engages a radial surface of the annular body of the support plate proximate the central opening.

7. The compressor of claim 1, wherein the non-orbiting scroll is attached to the support plate and the main bearing housing by separate fastening mechanisms.

8. The compressor of claim 7, wherein the non-orbiting scroll is threadedly attached to the support plate and the non-orbiting scroll is attached to the main bearing housing with fasteners.

9. The compressor of claim 1, wherein the compression subassembly further comprises a driveshaft positioned within the compressor housing and operably connected to the orbiting scroll for moving the orbiting scroll relative to the non-orbiting scroll.

10. A method of assembling a compressor, the method comprising:

assembling a compression subassembly by:

attaching a non-orbiting scroll to a support plate by threadedly engaging the non-orbiting scroll and the support plate, wherein the support plate comprises a radially extending flange member;

positioning an orbiting scroll on a surface of a main bearing housing; and attaching the main bearing housing to the non-orbiting scroll such that the orbiting scroll is positioned between the non-orbiting scroll and the main bearing housing;

installing the compression subassembly as a single unit in a first chamber defined by a shell of a compressor housing by positioning the support plate on the shell such that the compression subassembly is supported in the first chamber by the support plate, wherein positioning the support plate comprises:

seating the radially-extending flange member on a rim of the shell, and attaching the radially-extending flange member on the rim of the shell, wherein an axially-extending flange member is received by the rim to center the support plate on the shell, and wherein an outer edge at a leading end of the axially-extending flange member received by the rim is chamfered;

positioning an end cap of the compressor housing on the shell such that a second chamber is defined between the end cap and the shell, wherein the second chamber is separated from the first chamber by the support plate; and attaching the support plate and the end cap to the shell.

11. A compressor comprising:

a compressor housing comprising a shell defining a first chamber and an end cap defining a second chamber; and a compression subassembly installed in the compressor housing, the compression subassembly comprising:

a support plate positioned in the compressor housing between the shell and the end cap, wherein the support plate comprises an annular body separating the first chamber and the second chamber, the annular body having an inner circumferential surface defining a central opening, wherein the support plate comprises a radially-extending flange member stepped from an outer radial edge of the annular body, wherein the radially-extending flange member is seated on and attached to a rim of the shell, and an axially-extending flange member received by the rim to center the support plate on the shell, and wherein an outer edge at a leading end of the axially-extending flange member received by the rim is chamfered;

a non-orbiting scroll attached to the support plate and extending from the support plate into the first chamber, wherein the non-orbiting scroll comprises a raised portion extending into the central opening of the support plate, the raised portion defining a raised circumferential surface, wherein the raised circumferential surface and the inner circumferential surface of the support plate are in sealing engagement and comprise complementing threads for threadedly engaging one another;

a main bearing housing positioned in the first chamber and attached to the non-orbiting scroll; and an orbiting scroll positioned between the non-orbiting scroll and the main bearing housing;

wherein the compression subassembly is supported in the compressor housing by the support plate.

12. The compressor of claim 11, wherein the support plate and the non-orbiting scroll cooperatively seal the first chamber from the second chamber.

13. The compressor of claim 11, wherein an outer radial surface of the non-orbiting scroll is accessible via the central opening of the annular body.

14. The compressor of claim 11, wherein the support plate comprises a collar circumscribing the central opening and defining the inner circumferential surface and an outer circumferential surface, and wherein a flat is defined in the outer circumferential surface.

15. The compressor of claim 11, wherein the non-orbiting scroll is attached to the main bearing housing with fasteners.

16. The compressor of claim 11, wherein the raised portion of the non-orbiting scroll extends from a lower radial surface, wherein the lower radial surface engages a radial surface of the annular body of the support plate proximate the central opening.

17. The compressor of claim 11, wherein the non-orbiting scroll is attached to the support plate and the main bearing housing by separate fastening mechanisms.

18. The compressor of claim 17, wherein the non-orbiting scroll is threadedly attached to the support plate and the non-orbiting scroll is attached to the main bearing housing with fasteners.

19. The compressor of claim 11, wherein the compression subassembly further comprises a driveshaft positioned within the compressor housing and operably connected to the orbiting scroll for moving the orbiting scroll relative to the non-orbiting scroll.

20. A method of assembling a compressor, the method comprising:

assembling a compression subassembly by:

attaching a non-orbiting scroll to a support plate by threadedly engaging the non-orbiting scroll and the support plate, wherein the support plate comprises a radially extending flange member;

positioning an orbiting scroll on a surface of a main bearing housing; and attaching the main bearing housing to the non-orbiting scroll such that the orbiting scroll is positioned between the non-orbiting scroll and the main bearing housing;

installing the compression subassembly as a single unit in a first chamber defined by a shell of a compressor housing by positioning the support plate on the shell such that the compression subassembly is supported in the first chamber by the support plate, wherein positioning the support plate comprises:

seating the radially-extending flange member on a rim of the shell, and attaching the radially-extending flange member on the rim of the shell, wherein an axially-extending flange member is received by the rim to center the support plate on the shell, wherein the radially-extending flange member terminates prior to an outer radial edge of the rim; and positioning an end cap of the compressor housing on the shell such that a second chamber is defined between the end cap and the shell, wherein the second chamber is separated from the first chamber by the support plate, and wherein the end cap is seated on and attached to the rim of the shell and the end cap circumscribes the radially-extending flange member; and attaching the support plate and the end cap to the shell.

* * * * *